US009416606B2

(12) United States Patent
Harms et al.

(10) Patent No.: US 9,416,606 B2
(45) Date of Patent: Aug. 16, 2016

(54) WHILE DRILLING VALVE SYSTEM

(71) Applicant: Schlumberger Technology Corporation, Sugar Land, TX (US)

(72) Inventors: Kent David Harms, Richmond, TX (US); Jeremy T. Murphy, Sugar Land, TX (US); Michael J. Stucker, Sugar Land, TX (US); William E. Brennan, III, Richmond, TX (US); Albert Hoefel, Sugar Land, TX (US); Steven G. Villareal, Houston, TX (US); Julian J. Pop, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 670 days.

(21) Appl. No.: 13/676,655

(22) Filed: Nov. 14, 2012

(65) Prior Publication Data

US 2014/0131029 A1 May 15, 2014

(51) Int. Cl.

| | |
|---|---|
| ***E21B 21/10*** | (2006.01) |
| ***E21B 34/06*** | (2006.01) |
| ***E21B 49/08*** | (2006.01) |

(52) U.S. Cl.

CPC ..... *E21B 21/10* (2013.01); *E21B 34/066* (2013.01); *E21B 49/081* (2013.01)

(58) Field of Classification Search

None

See application file for complete search history.

(56) References Cited

U.S. PATENT DOCUMENTS

| | | | |
|---|---|---|---|
| 5,622,223 | A | 4/1997 | Vasquez |
| 6,026,915 | A | 2/2000 | Smith et al. |
| 7,367,394 | B2 | 5/2008 | Villareal et al. |

(Continued)

FOREIGN PATENT DOCUMENTS

| | | | |
|---|---|---|---|
| GB | 2334282 | A | 8/1999 |
| WO | 0114685 | A1 | 3/2001 |
| WO | 2011080586 | A2 | 7/2011 |

(Continued)

OTHER PUBLICATIONS

International Search Report and the Written Opinion for International Application No. PCT/US2013/068200 dated Feb. 10, 2014.

Supplementary Partial European Search Report issued in European Patent application EP13855148, dated May 18, 2016.

*Primary Examiner* — Jennifer H Gay

*Assistant Examiner* — Caroline Butcher

(74) *Attorney, Agent, or Firm* — Kenneth L. Kincaid

(57) ABSTRACT

A system includes a valve subassembly configured to be disposed along an internal flowline exit of a first internal flowline within a downhole drilling module. The valve subassembly includes an active valve configured to regulate flow of a fluid through the internal flowline exit and a passive valve configured to be passively controlled based on a differential pressure between a first volume of the downhole drilling module and a second volume surrounding the downhole drilling module.

17 Claims, 6 Drawing Sheets

(56) References Cited

U.S. PATENT DOCUMENTS

| | | | | |
|---|---|---|---|---|
| 7,543,659 | B2 | 6/2009 | Partouche et al. | |
| 7,845,405 | B2 | 12/2010 | Villareal et al. | |
| 7,938,199 | B2 | 5/2011 | Welshans et al. | |
| 2006/0076132 | A1 | 4/2006 | Nold, III et al. | |
| 2010/0319779 | A1 | 12/2010 | Harms et al. | |
| 2011/0068287 | A1 * | 3/2011 | Grimseth | F16K 31/56 251/213 |
| 2011/0114310 | A1 | 5/2011 | Ross et al. | |
| 2011/0198077 | A1 | 8/2011 | Kischkat et al. | |
| 2012/0132419 | A1 | 5/2012 | Zazovsky et al. | |
| 2013/0025855 | A1 * | 1/2013 | Glattetre | E21B 49/08 166/264 |
| 2013/0161007 | A1 * | 6/2013 | Wolfe | E21B 43/11857 166/297 |

FOREIGN PATENT DOCUMENTS

| | | | | |
|---|---|---|---|---|
| WO | 2012076878 | A1 | 6/2012 | |
| WO | WO 2012076878 | A1 * | 6/2012 | F16K 15/066 |
| WO | 2012104574 | A2 | 8/2012 | |

* cited by examiner

WHILE DRILLING VALVE SYSTEM

BACKGROUND

The present disclosure relates generally to drilling systems and more particularly to downhole drilling tools.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Wells are generally drilled into the ground or ocean bed to recover natural deposits of oil and gas, as well as other desirable materials that are trapped in geological formations in the Earth's crust. A well may be drilled using a drill bit attached to the lower end of a "drill string." Drilling fluid, or "mud," may be pumped down through the drill string to the drill bit. The drilling fluid lubricates and cools the drill bit, and it carries drill cuttings back to the surface in an annulus between the drill string and the borehole wall.

For successful oil and gas exploration, it is beneficial to have information about the subsurface formations that are penetrated by a borehole. For example, one aspect of standard formation evaluation relates to measurements of the formation pressure and formation permeability. These measurements may be used for predicting the production capacity and production lifetime of a subsurface formation.

One technique for measuring formation properties includes lowering a "wireline" tool into the well to measure formation properties. A wireline tool is a measurement tool that is suspended from a wire as it is lowered into a well so that it can measure formation properties at desired depths. A wireline tool may include a probe or packer inlet that may be pressed against the borehole wall to establish fluid communication with the formation. This type of wireline tool is often called a "formation tester." A formation tester measures the pressure of the formation fluids and generates a pressure pulse, which is used to determine the formation permeability. The formation tester tool may also withdraw a sample of the formation fluid for later analysis.

In order to use a wireline tool, whether the tool is a resistivity, sampling, porosity, or formation testing tool, the drill string is removed from the well so that the tool can be lowered into the well. This is called a "trip" downhole. Further, wireline tools are lowered to the zone of interest, generally at or near the bottom of the hole. A combination of removing the drill string and lowering the wireline tools downhole are time-consuming measures and can take up to several hours, depending upon the depth of the borehole. Because of the expense and rig time involved to "trip" the drill pipe and lower the wireline tools down the borehole, wireline tools are generally used when the information is greatly desired, or when the drill string is tripped for another reason, such as changing the drill bit.

As an improvement to wireline technology, techniques for measuring formation properties using tools and devices that are positioned near the drill bit in a drilling system have been developed. Thus, formation measurements are made during the drilling process, and the terminology generally used in the art is "MWD" (measurement-while-drilling) and "LWD" (logging-while-drilling). MWD refers to measuring the drill bit trajectory, as well as borehole temperature and pressure, while LWD refers to measuring formation parameters or properties, such as resistivity, porosity, permeability, and sonic velocity, among others. Real-time data, such as the formation pressure, allows the drilling entity to make decisions about drilling mud weight and composition, as well as decisions about drilling rate and weight-on-bit, during the drilling process.

Multiple moving parts involved in a formation testing tool, such as MWD and LWD tools, can result in less than optimal performance. Further, at greater depths, substantial hydrostatic pressure and high temperatures are experienced, thereby further complicating matters. Still further, formation testing tools are operated under a wide variety of conditions and parameters that are related to both the formation and the drilling conditions. Therefore, there is a need for improved downhole formation evaluation tools and improved techniques for operating and controlling downhole formation evaluation tools so that these tools are more reliable, efficient, and adaptable to formation and mud circulation conditions.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In a first embodiment, a system includes a valve subassembly to be disposed along an internal flowline exit of a first internal flowline within a downhole drilling module. The valve subassembly includes an active valve for regulating fluid flow through the internal flowline exit and a passive valve to regulate flow of the fluid through the internal flowline exit based on a pressure differential between a first pressure within a first volume defined by a collar surrounding the downhole drilling module and a second pressure within an annulus surrounding the collar when the downhole drilling module is disposed within a wellbore.

In another embodiment, a downhole drilling module includes an internal flowline for flowing a fluid and an internal flowline exit extending from the internal flowline to an external volume. The downhole drilling module further includes a valve subassembly disposed within the downhole drilling module and at the internal flowline exit of the internal flowline. The valve subassembly includes a piston, a spring to bias the piston in a first position, and a seal to block flow of the fluid from the internal flowline to the external volume when the piston is biased in the first position. The piston compresses the spring and opens the seal when a first pressure within a first volume defined by a collar surrounding the downhole drilling module is greater than a second pressure within an annulus surrounding the collar when the downhole drilling module is disposed within a wellbore.

In a further embodiment, a system includes a valve subassembly disposed within a downhole tool module and at an internal flowline exit of an internal flowline of the downhole tool module. The valve subassembly includes a first valve to regulate flow of a formation fluid through the internal flowline exit and a hydraulic circuit to actuate the first valve. The hydraulic circuit includes a flowline piston actuated by a fluid pressure within the internal flowline, a solenoid to regulate control a hydraulic fluid flow within the hydraulic circuit, and a valve piston coupled to the first valve. The valve piston is actuated by the hydraulic fluid flow.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

One or more specific embodiments of the present disclosure will be described below. These described embodiments are examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Present embodiments are directed to systems for controlling a flow of fluid through a drilling tool. In certain embodiments, the drilling tool includes a valve subassembly that controls the flow of fluid through the internal flowline of the drilling tool. For example, the valve subassembly may be a self-contained subassembly that may be placed in the drilling tool. Additionally, the valve assembly includes connections to couple the internal flowline to other flowlines or flowline exits and may be positioned in different locations or positions within the drilling tool. As discussed in detail below, the valve subassembly includes a valve (e.g., a two-position valve) that may be actively controlled (e.g., actuated by motors, solenoids, hydraulic pressure, etc.), passively controlled, or both. The valve may be actively or passively opened or closed to regulate the flow of fluid through the internal flowline. While the valve subassembly may be located anywhere within the drilling tool, in certain embodiments, the valve subassembly is positioned along the internal flowline and proximate to a flowline exit of the drilling tool. This position allows the valve subassembly to regulate a fluid flow exiting the internal flowline. For example, the flowline exit may extend from an internal flowline to the annulus surrounding the drilling tool, to a volume outside the drilling tool and another drilling tool component, or to another internal flowline.

Figure 1:
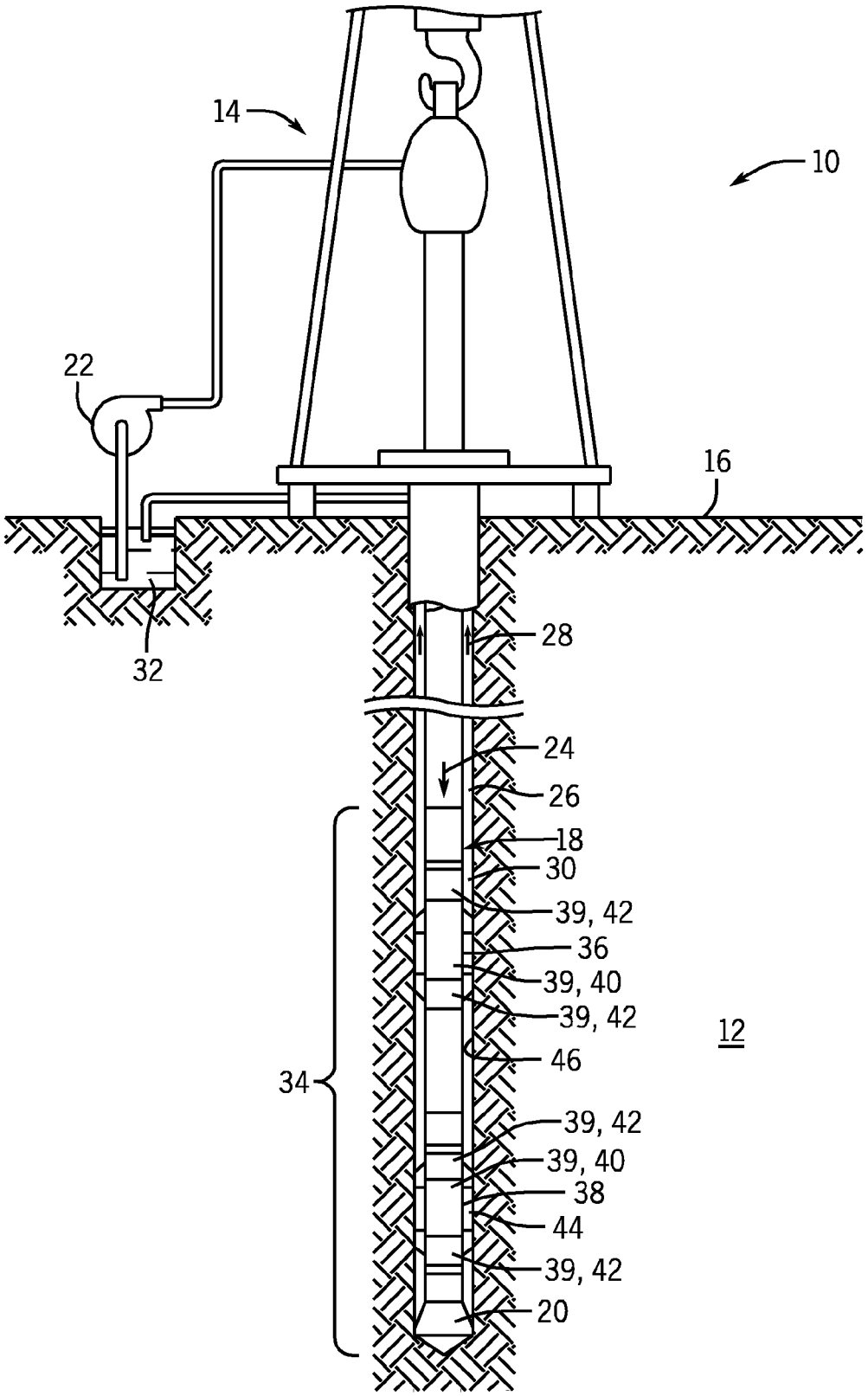
FIG. 1 is a partial cross sectional view of an embodiment of a drilling system used to drill a well through subsurface formations.

FIG. 1 illustrates a drilling system 10 used to drill a well through subsurface formations 12. A drilling rig 14 at the surface 16 is used to rotate a drill string 18 that includes a drill bit 20 at its lower end. As the drill bit 20 is rotated, a "mud" pump 22 is used to pump drilling fluid, commonly referred to as "mud" or "drilling mud," downward through the drill string 18 in the direction of the arrow 24 to the drill bit 20. The mud, which is used to cool and lubricate the drill bit 20, exits the drill string 18 through ports (not shown) in the drill bit 20. The mud then carries drill cuttings away from the bottom of the borehole 26 as it flows back to the surface 16, as shown by the arrows 28, through the annulus 30 between the drill string 18 and the formation 12. While a drill string 18 is illustrated in FIG. 1, it will be understood that the embodiments described herein are applicable to work strings and pipe strings as well. At the surface 16, the return mud is filtered and conveyed back to a mud pit 32 for reuse.

As illustrated in FIG. 1, the lower end of the drill string 18 includes a bottom-hole assembly ("BHA") 34 that includes the drill bit 20, as well as a plurality of drill collars 36, 38 that may include various instruments and subassemblies 39 such as sample-while-drilling ("SWD") tools that include sensors, telemetry equipment, pumps, sample chambers, and so forth. For example, the drill collars 36, 38 may include logging-while-drilling ("LWD") modules 40 and/or measurement-while drilling ("MWD") modules 42. The LWD modules 40 of FIG. 1 are each housed in a special type of drill collar 36, 38, and each contain any number of logging tools and/or fluid sampling devices. The LWD modules 40 include capabilities for measuring, processing and/or storing information, as well as for communicating with the MWD modules 42 and/or directly with the surface equipment such as a logging and control computer.

In certain embodiments, the tools may also include or be disposed within a centralizer or stabilizer 44. For example, the centralizer/stabilizer 44 may include blades that are in contact with the borehole wall 46 as shown in FIG. 1 to limit "wobble" of the drill bit 20. "Wobble" is the tendency of the drill string 18, as it rotates, to deviate from the vertical axis of the borehole 26 and cause the drill bit 20 to change direction. Because the centralizer/stabilizer 44 is already in contact with the borehole wall 46, a probe is extended a relatively small distance from the tool to establish fluid communication with the formation 12. It will be understood that a formation probe may be disposed in locations other than in the centralizer/stabilizer 44 without departing from the scope of the presently disclosed embodiments.

Figure 2:
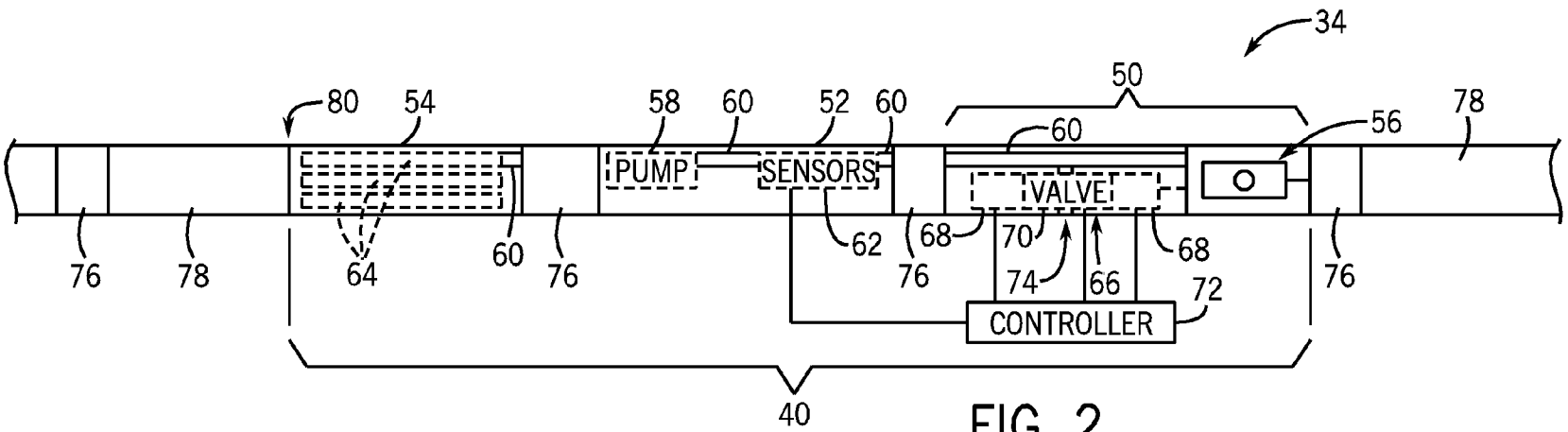
FIG. 2 is a schematic diagram of an embodiment of downhole drilling equipment used to sample a formation.

FIG. 2 is a schematic diagram of an embodiment of downhole drilling equipment that may form part of the BHA 34 of FIG. 1. Specifically, the illustrated downhole drilling equipment includes a LWD tool 40 that may be used to collect fluid samples from the formation 12 during the drilling process. The tool 40 includes a probe module 50, a pump-out module 52, and a sample carrier module 54, which work together to collect formation fluid samples. The probe module 50 includes an extendable probe 56 designed to engage the formation 12 and to communicate fluid samples from the formation 12 into the tool 40. In addition to the probe 56, the probe module 50 includes certain electronics, batteries, and/or hydraulic components used to operate the probe 56. Further, although the probe module 50 is described herein as including a single extendable probe 56, in other embodiments, the techniques described herein may be employed with other types of probes, such as dual probe modules, straddle packer probe modules, or single packer probe modules, among others.

The pump-out module 52 is configured to provide hydraulic power to direct sampling fluid from the probe module 50 through the tool 40 and into the sample carrier module 54. In certain embodiments, the pump-out module 52 includes a pump 58 for pumping formation sample fluid from the probe module 50 to the sample carrier module 54 and/or out of the tool 40. More specifically, the pump 58 is configured to pump a fluid through an internal flowline 60 extending through the tool 40. In an embodiment, the pump 58 may include an electromechanical pump, which operates via a piston displacement unit (DU) driven by a ball screw, such as a planetary rollerscrew, coupled to an electric motor. Mud check valves may be employed to direct pumping fluid in and out of chambers of the DU, thereby allowing continuous pumping of formation fluid, even as the DU switches direction. In certain embodiments, power may be supplied to the pump 58 via a dedicated mud turbine/alternator system. In addition to the pump 58, the pump-out module 52 may include a number of sensors 62 used to monitor one or more parameters of the sample fluid moving through the internal flowline 60 of the pump-out module 52. For example, the sensors 62 may include two pressure gauges, one to monitor an inlet pressure (e.g., pressure of the probe module 50), and another to monitor an outlet pressure (e.g., pressure of fluid entering the sample carrier module 54). Although the pump-out module 52 is included in the illustrated embodiment of the tool 40, it should be noted that the tool may operate without a separate pump-out module 52. For example, certain components internal to the illustrated pump-out module 52 may be located in other sections of the tool 40. As another example, the tool 40 may sample the well formation via the probe module 50 without using a pump to flow fluid through the internal flowline 60 of the tool 40. For example, the probe module may be employed to take formation pressure measurements by withdrawing a small portion of formation fluid into the probe, and then expelling the formation fluid to the wellbore.

Once the formation fluid is taken into the probe module 50, the pump 58 urges the formation fluid through the internal flowline 60 of the tool 40 and toward the sample carrier module 54. The sample carrier module 54, in general, includes three sample carriers 64, which may be sample bottles configured to receive and store the sample fluid (samples of formation fluid taken by the probe module 50). The sample carrier module 54 may then be brought to the surface for testing of the fluid samples. Valves are employed to open the sample carriers 64, e.g., one at a time, to receive the sample fluid pumped through the tool 40 and to close the sample carrier 64 when they are filled to a desired level. In certain embodiments, the tool 40 may operate without the illustrated sample carrier module 54.

For example, the LWD tool 40 may utilize the probe module 50 to obtain formation pressure measurements. In these embodiments, the LWD tool 40 may include sensors (e.g., 62) for determining properties of the formation fluid, which may be drawn into the probe module 50 and then released to the wellbore.

As mentioned above, the drilling tool (e.g., LWD tool 40) includes a valve subassembly 66 configured to regulate flow of the formation or sample fluid through the internal flowline 60. For example, as discussed in detail below, the valve subassembly 66 may be a passive valve subassembly (see FIG. 8) or an active valve subassembly. In an active valve subassembly, the valve subassembly 66 may include one or more actuation mechanisms 68, which operate to open or close a valve 70 of the valve subassembly 66. The actuation mechanisms 68 may include motors, magnets, springs, solenoids, pumps, and so forth. As discussed in detail below, the valve subassembly 66 (e.g., the actuation mechanisms 68) may be configured to use relatively little power and occupy relatively little space. For example, in certain embodiments, the valve subassembly 66 may use less than 100 watts to operate, such that the actuation mechanisms 68 may be powered by local power sources located in the tool or via relatively low-power connections with the drilling rig 14. Additionally, while the illustrated embodiment shows the valve subassembly 66 positioned between the probe 56 and the pump-out module 58, in other embodiments the valve subassembly 66 may be positioned in other locations within the tool 40. For example, the valve subassembly 66 may be function as an exit port at the sample carrier module 54 (e.g., at a location 80 proximate to the sample carriers 64). In such an embodiment, the valve assembly 66 may also use less than 100 watts during operation, as described above.

Furthermore, in certain embodiments, the actuation mechanisms 68 may be actuated by a controller 72 (e.g., a downhole controller). For example, the controller 72 may be configured to automatically actuate or operate the actuation mechanisms 68 based on feedback from the tool 40 (e.g., sensors 62), preset conditions, and so forth. Additionally, the controller 72 may be configured to actuate or operate the actuation mechanisms 68 based on user input. For example, a user or operator (e.g., at the drilling rig 14 or other location at the surface 16) may use the controller 72 to actuate one or more of the actuation mechanisms 68.

As discussed above, the valve subassembly 66 may be positioned along the internal flowline 60 at a flowline exit 74. While the flowline exit 74 is located near the probe module 50 in the illustrated embodiment, the flowline exit 74 regulated by the valve subassembly 66 may be in other locations within the tool 40, such as location 80 proximate to the sample carriers 64. The flowline exit 74 serves to direct fluid flowing through the internal flowline 60 to another flow passage, such as the annulus 30 surrounding the BHA 34, to a volume outside the tool 40 and inside the drill collars 36, 38, or to another internal flowline. For example, as discussed below, when the valve subassembly 66 is in an open position, fluid may be allowed to flow from the internal flowline 60 to another flow passage, and when the valve subassembly 66 is in a closed position, fluid may be blocked from flowing out of the internal flowline 60 through the flowline exit 74. Additionally, the valve subassembly 66 may be positioned in various locations within the tool 40 (e.g., along a continuous or non-continuous internal flowline 60).

As previously discussed, the tool 40 represents a portion of the BHA 34 and the entire drill string 18. As the drill string 18 is assembled at the surface 16, the modules of the tool 40 are connected via field joints 76. The field joints 76 represent rugged connections between drilling equipment that may be assembled at the well site. The field joints 76 may facilitate one or more rotatable electrical and/or hydraulic connections. Accordingly, the field joints 76 may be specially designed to provide electrical communication, sampling fluid communication, and/or hydraulic fluid communication between the probe module 50, the pump-out module 52, the sample carrier module 54, and other drilling equipment 78. This other drilling equipment 78 may include other sampling modules, other drill collars, or other drill string components. In some embodiments, the other drilling equipment 78 may include additional modules of the same tool 40, such as another pump-out module 52 on the other side of the probe module 52, additional sample carrier modules 54, or additional valve subassemblies 66. Since the field joints 72 provide rotatable connections between these modules, the modules may be positioned in any orientation relative to each other without fluid and/or electricity flowing to an undesired location.

Figure 3:
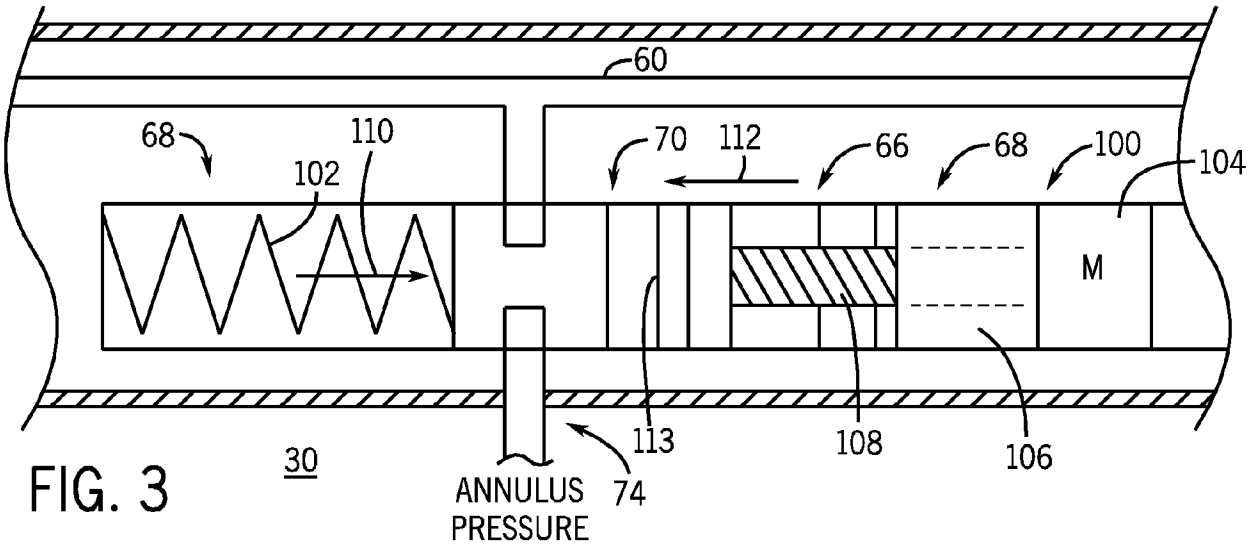
FIG. 3 is a schematic diagram of an embodiment of a valve subassembly used in downhole drilling equipment.

FIG. 3 is a schematic diagram of downhole drilling equipment that may form part of the BHA 34 of FIG. 1, illustrating an embodiment of the valve subassembly 66. As mentioned above, the valve subassembly 66 is configured to regulate fluid flow through the internal flowline 60 and/or through the valve subassembly 66 and enable or block flow of the fluid out of the internal flowline 60 (e.g., through the flowline exit 74). In the illustrated embodiment, the flowline exit 74 extends from the internal flowline 60 to the annulus 30 surrounding the BHA 34. As shown, the valve subassembly 66 (e.g., the valve 70) is positioned along the flowline exit 74 and therefore may block or enable fluid flow from the internal flowline 60 to the annulus 30 surrounding the BHA 34. In other words, the illustrated valve 70 is a two-position valve. Specifically, the valve 70 has an open position and a closed position. However, other valves 70 may have more than two positions. For example, a three or four way valve may be employed, which in addition to blocking or enabling fluid flow from the internal flowline 60 to the annulus 30. Accordingly, the valve subassembly 66 may enable flow of a fluid from the internal flowline 60 to multiple other flow passages (e.g., annulus 30, volume between outside tool 40 and inside the drill collars 36, 38, or another internal flowline).

As mentioned above, the valve subassembly 66 includes one or more actuation mechanisms 68 that are configured to open and/or close the valve 70 of the valve subassembly 66. In the illustrated embodiment, the valve subassembly 66 includes two actuation mechanisms 68 positioned on opposite sides of the valve 70. Specifically, the valve subassembly 66 includes a motor assembly 100 positioned on one side of the valve 70 and a spring 102 positioned on another (e.g., opposite) side of the valve 70. As shown, the motor assembly 100 has multiple components, such as a motor 104, a gear box 106, and a roller screw 108. However, in other embodiments, the gear box 106 may not be included in the motor assembly 100. The motor assembly 100 may also include other components, such as electronics, pumps (e.g., a flush pump), lubricant systems, and sensors, among others.

In the illustrated embodiment, the valve 70 is shown in the closed position. In the unactuated position, the valve 70 blocks fluid flow from the internal flowline 60 to the annulus 30 through the flowline exit 74. Specifically, a force applied by the spring 102 of the valve subassembly 66 biases the valve 70 in the closed position, as indicated by arrow 110. However, in other embodiments, the valve 70 may be a normally open valve. Accordingly, in the unactuated position, the force applied by the spring 102 may bias the valve 70 in an open position. When the valve subassembly 66 is actuated (e.g., by the controller 72), the motor assembly 100 operates to overcome the biasing force of the spring 102, and the valve 70 is moved into the open position to allow a fluid to flow from the internal flowline 60 to the annulus 30 through the flowline exit 74. More specifically, the motor 104 drives the roller screw 108 in a direction 112, and the roller screw 108 moves the valve 70 into the open position to align flow passage 113 with the internal flowline 60. Similarly, the motor assembly 100 may be actuated to return the valve 70 to the closed position. For example, the motor 104 may be driven to return the roller screw 108 to the position shown in FIG. 3. As such, the biasing force of the spring 102 will force the valve 70 to return to the closed position shown in FIG. 3. As mentioned above, while the valve subassembly 66 is biased in the closed position in the illustrated embodiment, the valve assembly 66 may be biased in the open position in other embodiments.

Figure 4:
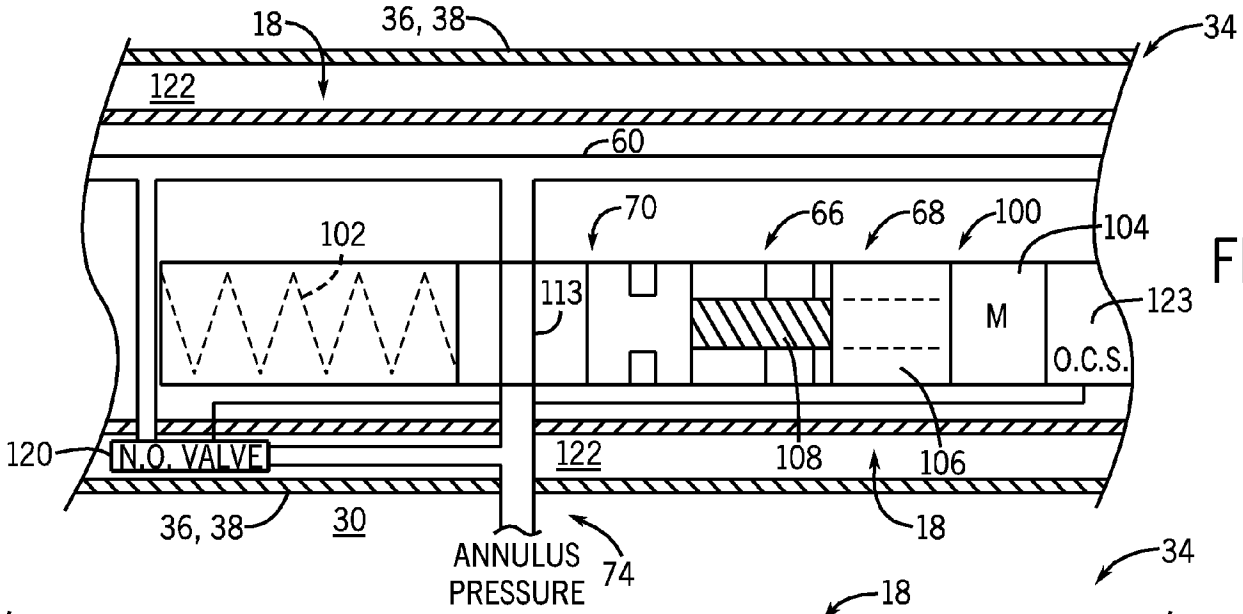
FIG. 4 is a schematic diagram of another embodiment of a valve subassembly used in downhole drilling equipment.

FIG. 4 is a schematic diagram of downhole drilling equipment that may form part of the BHA 34 of FIG. 1, illustrating another embodiment of the valve subassembly 66. The illustrated embodiment includes similar elements and element numbers as the embodiment shown in FIG. 3. Additionally, the illustrated embodiment of the valve subassembly 66 includes a normally open valve 120, which is positioned in a volume 122 between the drill string 18 and the collars 36, 38. The normally open valve 120 is controlled by the differential pressure between the inside of the collars 36, 38 (e.g., internal pressure) and the outside the tool 40 (e.g., annulus pressure). Accordingly, the normally open valve 120 may be in a closed position (e.g., thereby blocking flow from the internal flowline 60 to the annulus 30) when the drilling system 10 is not flowing a fluid through the interior of the tool (i.e., when the internal pressure is approximately equal to the pressure of the annulus 30). Conversely, the normally open valve 120 may be in an open position (e.g., thereby enabling flow from the internal flowline 60 to the annulus 30) when the drilling system 10 is flowing formation fluid through the interior of the tool (i.e., when the internal pressure is greater than the pressure of the annulus 30). In other words, the position of the normally open valve 120 is dependent on whether the drilling system 10 is circulating a formation fluid. Additionally, the normally open valve 120 is operatively coupled to an oil compensation system 123 of the valve subassembly 66. The operation of the normally open valve 120 is described in further detail below with reference to FIG. 9. Because the normally open valve 120 operates based on pressure differential, rather than mechanical or electrical actuation, the normally open valve 120 is a passive valve component of the valve subassembly 66.

Furthermore, as similarly described in detail above, the illustrated valve subassembly 66 includes the valve 70, the motor assembly 100 and may include the spring 102 (e.g., biasing spring). Although the normally open valve 120 is a passive valve component, the valve subassembly 66 also includes the motor assembly 100, which provides an active valve component to the valve subassembly 66. The motor assembly 100 enables a user to control a flow from the internal flowline 60 to the annulus 30 through the flowline exit 74. For example, the motor assembly 100 may be operatively coupled to the controller 72 shown in FIG. 2. As mentioned above, the controller 72 may be configured to actuate or operate the valve assembly 66 (e.g., the motor assembly 100) based on user input. In one embodiment, a user or operator (e.g., at the drilling rig 14 or other location at the surface 16) may control operation of the motor assembly 100 and thereby control operation of the valve assembly 66. In other embodiments, the valve assembly 66 may not include the valve 70, the motor assembly 100, and/or the spring 102 when the valve subassembly 66 includes the normally open valve 120. In these embodiments, the valve subassembly 66 may simply include passive valve components.

Figure 9:
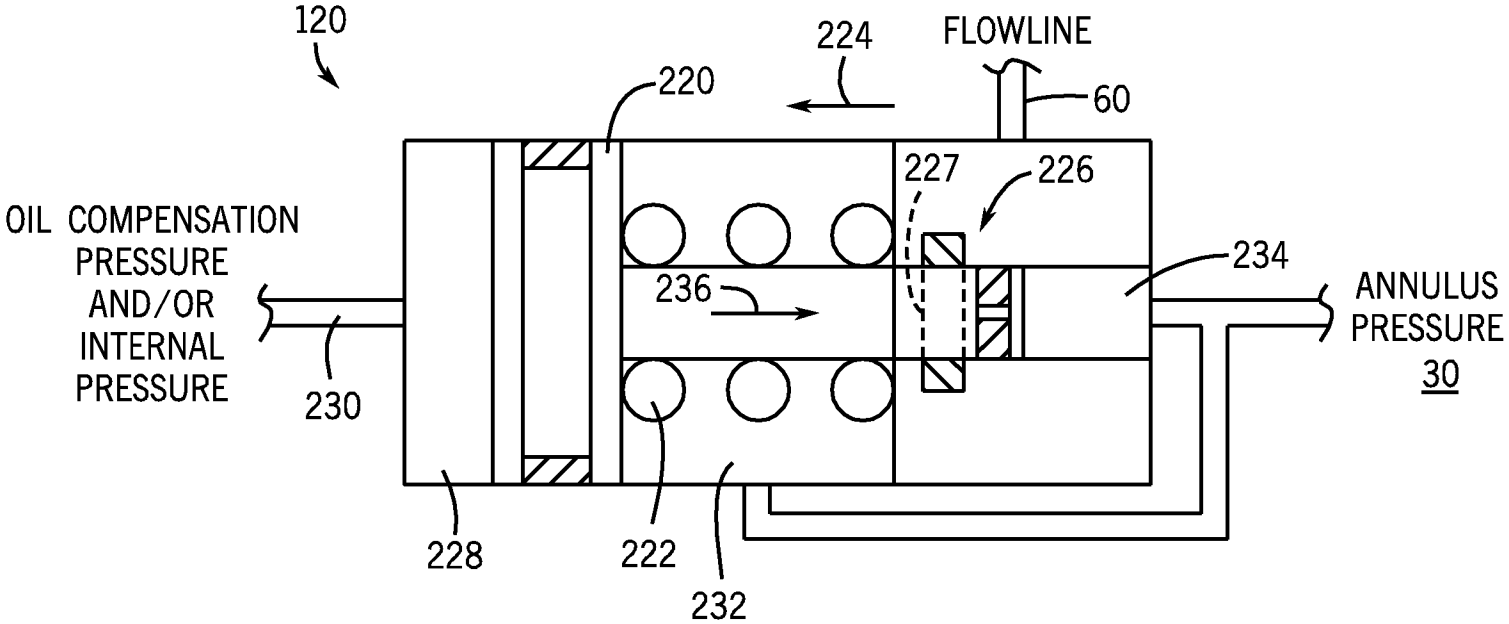
FIG. 9 is a schematic diagram of another embodiment of a valve subassembly used in downhole drilling equipment.

Referring now to FIG. 9, a schematic of an embodiment of the normally open valve 120 is illustrated. As mentioned above, the normally open valve 120 is configured to regulate flow from the internal flowline 60 to the annulus 30 based on a differential pressure between the inside of the collars 36, 38 (e.g., an internal pressure or oil compensation system 123 pressure) and the outside the tool 40 (e.g., annulus pressure). The normally open valve 120 includes a piston 220 that is driven or actuated by the differential pressure between the inside of the collars 36, 38 (e.g., an internal pressure or oil compensation system 123 pressure) and the outside the tool 40 (e.g., annulus pressure). As the piston 220 is driven or actuated from one position to another, the normally open valve 120 is opened or closed. Additionally, the normally open valve 120 includes a spring 222, which biases the piston 220 towards one position. More specifically, in the illustrated embodiment, the spring 222 biases the piston 220 such that the normally open valve 120 is in a closed position. That is, the spring 222, when uncompressed, biases the piston 220 in a direction 224, thereby closing a seal 226 of the normally open valve 120 and blocking flow from the internal flowline 60 to the annulus 30. For example, when the seal 226 is in the closed position, the seal 226 may be in a position 227, thereby blocking fluid through the normally open valve 120.

A piston chamber 228 of the normally open valve 120 is coupled to a conduit 230 that extends from the oil compensation system 123 and/or the volume 122 between the drill string 18 and the collars 36, 38. As such, the oil compensation system 123 pressure and/or the internal pressure within the volume 122 extends to the piston chamber 228 of the normally open valve 120. Additionally, a spring cavity 232 and a valve port 234 of the normally open valve 120 are exposed to the annulus pressure of the annulus 30 outside the tool 40. As shown, the spring cavity 232 and the valve port 224 are disposed on the opposite side of the piston 220 from the piston chamber 228. In operation, when the oil compensation system 123 pressure and/or internal pressure (i.e., the pressure within the piston chamber 228) is approximately equal to the annulus 30 pressure (i.e., the pressure within the spring cavity 232 and the valve port 234), the spring 222 is uncompressed and the piston 220 is biased in the direction 224. Thus, the seal 226 and the normally open valve 120 are closed, thereby blocking fluid flow from the internal flowline 60 to the annulus 30.

When the rig pumps are flowing, the oil compensation pressure 123 and/or the internal pressure may be greater than the annulus 30 pressure. Consequently, the pressure within the piston chamber 228 is greater than the pressure within the spring cavity 232 and the valve port 234, thereby creating a pressure differential across the piston 220. This pressure differential acting on the piston 220 actuates or drives the piston 220 in a direction 236. As the piston 220 moves in the direction 236, the seal 226 of the normally open valve 120 is opened, and fluid flow from the internal flowline 60 to the annulus 30 is enabled. As will be appreciated, when rig pumps are flowing (e.g., the tool 40 is sampling a formation fluid) the opening of the normally open valve 120 may allow pressure equalization between the internal flowline 60 and the annulus 30. Thereafter, when the rig pumps stop flowing a formation fluid, the oil compensation system 123 pressure and/or the internal pressure within the volume 122 may decrease to approximately the annulus 30 pressure, causing the differential pressure across the piston 220 to reduce and enabling the spring 222 to uncompress and close the seal 226 and the normally open valve 120.

Figure 5:
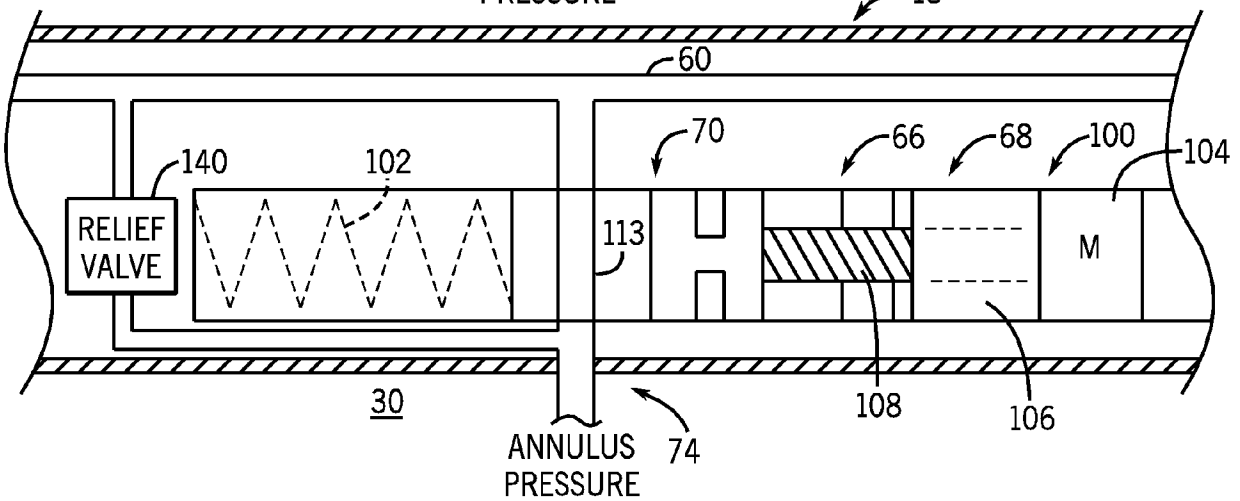
FIG. 5 is a schematic diagram of another embodiment of a valve subassembly used in downhole drilling equipment.

FIG. 5 is a schematic diagram of downhole drilling equipment that may form part of the BHA 34 of FIG. 1, illustrating another embodiment of the valve subassembly 66. The illustrated embodiment includes similar elements and element numbers as the embodiment shown in FIG. 3. Additionally, the illustrated embodiment of the valve subassembly 66 includes a relief valve 140. More specifically, the relief valve 140 is a passive relief valve that is passively controlled by the differential pressure across the internal flowline 60 and the pressure of the annulus 30. The flowline exit 74 is not necessarily normally open, but the internal flowline 60 pressure is pressure limited to the pressure of the annulus 30. In other words, when the annulus 30 pressure exceeds the internal flowline 60 pressure, the relief valve 140 may close, thereby blocking flow from the internal flowline 60 to the annulus 30. In other embodiments, the relief valve 140 may be replaced with a rupture disk. However, as will be appreciated by those skilled in the art, a rupture disk would not re-seal after actuation.

Additionally, the illustrated valve subassembly 66 includes the valve 70, the motor assembly 100 and may include the spring 102 (e.g., biasing spring). As discussed above with respect to FIG. 3, the motor assembly 100 provides an active valve component to supplement the passive relief valve 140. As a result, a user may be able to control a flow from the internal flowline 60 to the annulus 30 through the flowline exit 74 by driving the motor assembly 100 to change the position of the valve 70. Other embodiments may not include the valve 70, the motor assembly 100, and/or the spring 102 when the valve subassembly 66 includes the relief valve 140. In these embodiments, the valve subassembly 66 may simply include passive valve components.

Figure 6:
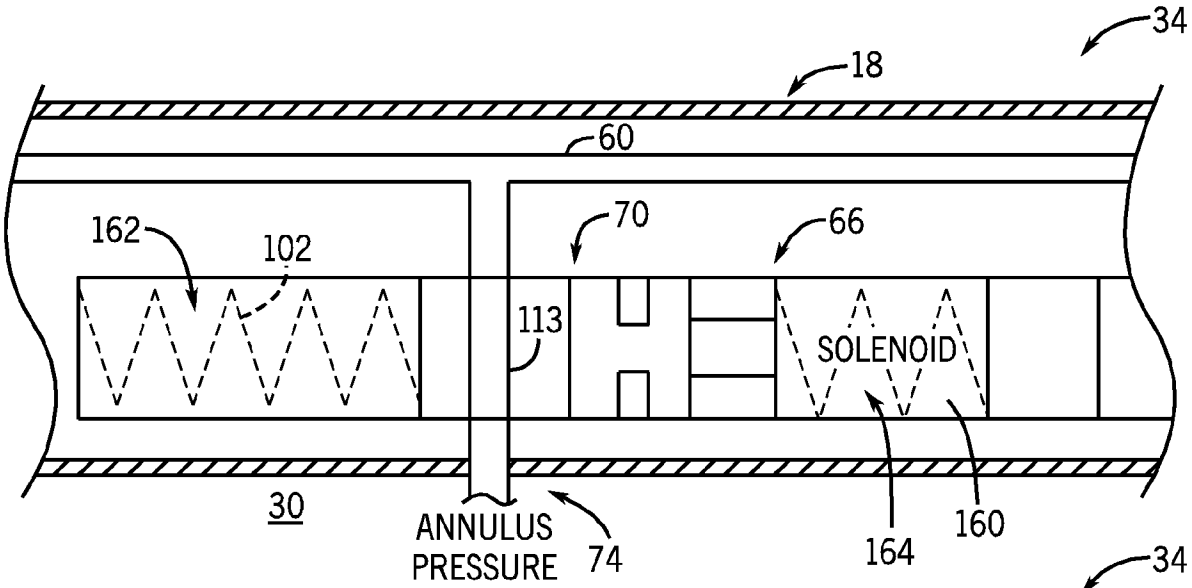
FIG. 6 is a schematic diagram of another embodiment of a valve subassembly used in downhole drilling equipment.

FIG. 6 is a schematic diagram of downhole drilling equipment that may form part of the BHA 34 of FIG. 1, illustrating another embodiment of the valve subassembly 66. In the illustrated embodiment, the valve subassembly 66 includes a solenoid 160, which utilizes a fluid from the internal flowline 60. The solenoid 160 is coupled to the valve 70 (e.g., two-position valve) and therefore actuates the valve 70 between open and closed positions. In one embodiment, the solenoid 160 is a single acting solenoid. In this embodiment, the valve subassembly 66 includes the spring 102 (e.g., biasing spring). For example, the spring 102 may be positioned on a side of the valve 70 opposite the solenoid, as indicated by arrow 162, or the spring 102 may be a back-driving spring positioned within the solenoid 160, as indicated by arrow 164. In certain embodiments, the valve subassembly 66 that has the single acting solenoid 160 may include two springs 102 (e.g., a biasing spring and a back-driving spring). In another embodiment, the single acting solenoid 160 may be biased in one direction by a magnet assembly. Moreover, as similarly discussed above, the valve 70 may be biased in either the open or closed position, and the solenoid 160 may actuate to either close or open the valve 70. In other embodiments, the solenoid 160 may have two bi-stable positions. In such an embodiment, the solenoid 160 may operate to open and close the valve 70.

Figure 7:
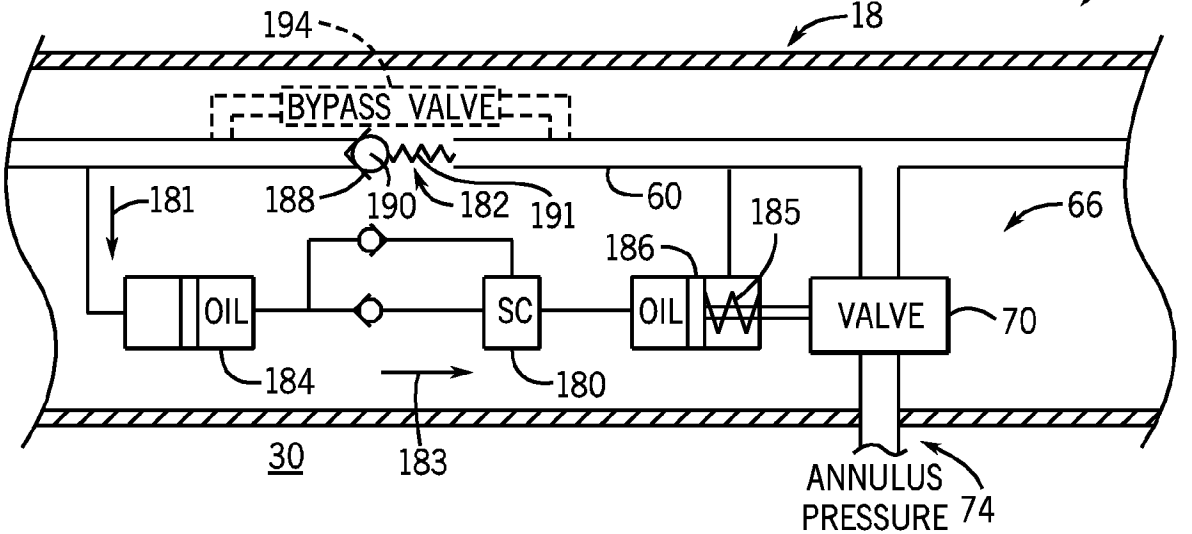
FIG. 7 is a schematic diagram of another embodiment of a valve subassembly used in downhole drilling equipment.

FIG. 7 is a schematic diagram of downhole drilling equipment that may form part of the BHA 34 of FIG. 1, illustrating another embodiment of the valve subassembly 66 where the valve 70 is actively controlled. Specifically, the valve 70 is actively controlled by a hydraulic circuit. The illustrated valve subassembly 66 includes a solenoid 180, a leak valve 182, a flowline piston 184, and a valve piston 186 to actuate the valve 70 (e.g., a mud valve). When the solenoid 180 is not activated, the valve 70 is in an open position, thereby enabling flow from the internal flowline 60 to the annulus 30. More particularly, a spring 185 of the valve piston 186 biases the valve 70 in an open position. However, while the valve 70 is open, the leak valve 182 may at least partially block fluid flow from the internal flowline 60 to the annulus 30. Specifically, the leak valve 182 includes a seat 188 and a ball 190, which is biased toward the seat 188 by a spring 191. The force of the spring 191 (e.g., the size of the spring 191) may be selected to provide a desired pressure (e.g., back pressure) on the ball 190. As the ball 190 is biased toward the seat 188, fluid flow is at least partially blocked through the leak valve 182. As a result, fluid flow within the internal flowline 60 may be redirected toward the flowline piston 184, as indicated by arrow 181. As fluid pressure is built up within the flowline piston 184, the fluid pressure within the internal flowline 60 may act on the ball 190 of the leak valve 182 (e.g., against the spring 191), thereby causing the ball 190 to allow a leak flow of fluid across the leak valve 182.

To close the valve 70, the solenoid 180 is activated. Specifically, once the solenoid 180 is activated, the fluid pressure built up in the flowline piston 184 causes hydraulic fluid (e.g., oil) to flow through the hydraulic circuit (e.g., in a direction 183) and act on the valve piston 186, which is coupled to the valve 70. The hydraulic fluid pressure acting on the valve piston 186 causes the valve piston to compress the spring 185 and actuate (e.g., close) the valve 70, thereby blocking fluid flow from the internal flowline 60 to the annulus 30. As will be appreciated, the solenoid 180 controls flow of hydraulic fluid (e.g., oil) instead of flow of fluid flowing through the internal flowline 60, and thus may be smaller and use less power than the solenoid 160 shown in FIG. 6. Additionally, the relative sizes of the flowline piston 184 and the valve piston 186 may amplify the pressure generated by the leak valve 182 to provide more force for closing the valve 70. The valve 70 may be re-opened by deactivating the solenoid 180 and dropping the pressure within the internal flowline 60. Furthermore, as mentioned above, the leak valve 182 may include a small leak path that serves to equalize the internal flowline 60 pressure when fluid flow through the internal flowline 60 stops.

In certain embodiments, the valve subassembly 66 shown in FIG. 7 may include a bypass valve 194. In such an embodiment, the leak valve 182 may be a flowline relief valve. When the valve 70 is closed, pressure may build within the internal flowline 60 up to a maximum pump output pressure. The pressure built up within the internal flowline 60 may be used to operate the bypass valve 194 that would short circuit the flowline relief valve, thereby providing a leak path to allow the valve 70 to open. The bypass valve 194 may include a variety of components, such as relief valves, chokes, check valves, and so forth to ensure that the bypass valve 194 does not operate until the valve 70 is closed. Additionally, the various components of the bypass valve 194 may be configured to increase the piston ratios of the hydraulic circuit of the valve assembly 66. That is, the bypass valve 194 may provide more hydraulic power for actuating the valve 70.

Figure 8:
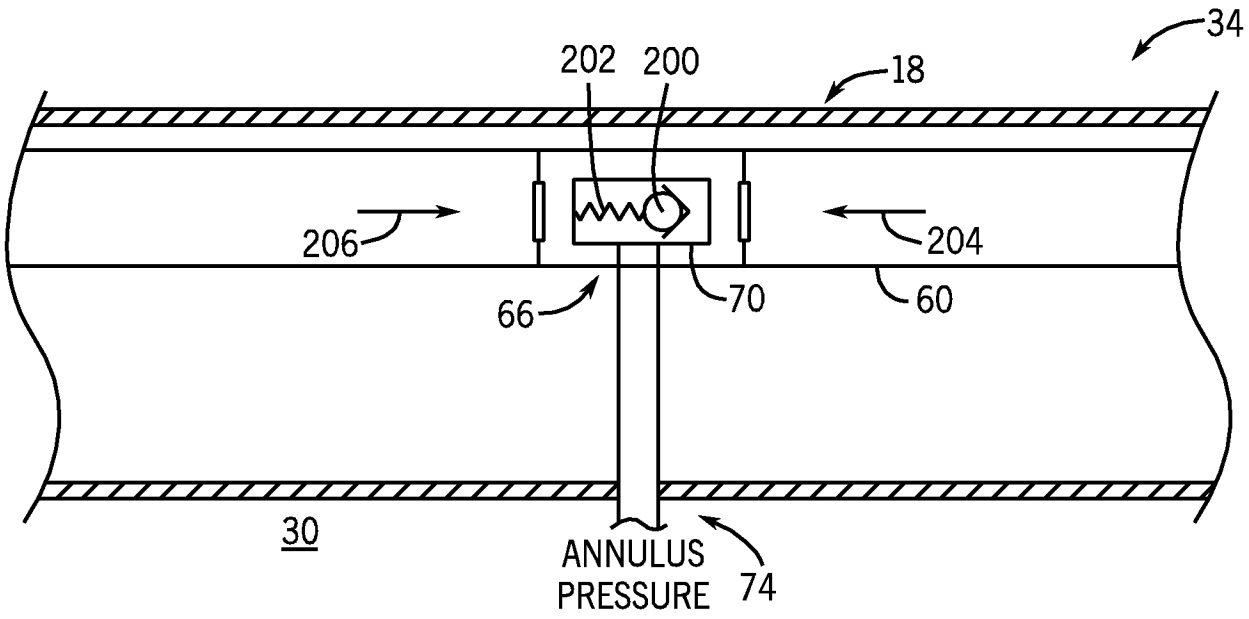
FIG. 8 is a schematic diagram of another embodiment of a valve subassembly used in downhole drilling equipment.

FIG. 8 is a schematic diagram of downhole drilling equipment that may form part of the BHA 34 of FIG. 1, illustrating another embodiment of the valve subassembly 66 where the valve 70 is passively controlled. In the illustrated embodiment, the valve 70 is a relief valve (e.g., similar to the relief valve 140 shown in FIG. 5). In the illustrated embodiment, the valve 70 includes a ball 200 and a spring 202, which open the internal flowline 60 to the annulus 30. For example, in the illustrated configuration, the valve 70 may open the internal flowline 60 to the annulus 30 when a fluid is flowing in a direction 204, and the valve 70 may close when a fluid is flowing the a direction 206. In another embodiment, the valve 70 configuration may be reversed. That is, the valve 70 may be open, thereby enabling flow from the internal flowline 60 to the annulus 30, when a fluid is flowing in the direction 206, and the valve 70 may close when a fluid is flowing in the direction 204. As similarly discussed above, the valve 70 may also direct flow from the internal flowline 60 to another internal flowline 60 or to the volume 122 between the drill string 18 and the collars 36, 38. Moreover, the passively controlled valve 70 may have other configurations. For example, the valve 70 may include a rupture disk or other relief valve.

As discussed in detail above, present embodiments include valve subassemblies for controlling a flow of fluid through the internal flowline 60 of a drilling tool, such as the tool 40. The tool 40 includes the valve subassembly 66 that controls the flow of a fluid through the internal flowline 60 of the tool 40. For example, in certain embodiments, the valve subassembly 66 may be configured to route or equalize the internal flowline 60 to another internal flowline position, to the BHA annulus 30, to the volume 122 outside the tool mandrel and inside the collar 36, 38 or multiple (e.g., two or more) different positions. The valve subassembly 66 may be actuated actively, passive, or by a combination of active and passive valve components. In one embodiment, the valve subassembly 66 includes the valve 70 (e.g., a two-position valve) that may be actively controlled, passively controlled, or both, by actuation mechanisms 68. For example, the actuation mechanisms 58 may include the motor assembly 100 having the gear box 106 and/or the power or roller screw 108, which provides active valve components. The valve assembly 66 may also include one or more springs 102 configured to actuate the valve 70. In another embodiment, the valve assembly 66 may be actuated by the solenoid 160, 180 (e.g., a single acting solenoid or bi-stable position solenoid). The various actuation mechanisms 58 may utilize low power, such as less than 100 watts.

Furthermore, in yet other embodiments, the valve assembly 66 may be actuated by differential pressures, such as an internal flowline 60 pressure drop, external rig pump pressure drops (e.g., within the volume 122 and/or the annulus 30), or a differential pressure of amplified hydraulics with a step piston, which provides passive valve components. Additionally, the valve subassembly 66 may be configured to actuate based on rig 14 pump circulation. For example, the valve subassembly 66 may be actuated with rig 14 flow or may be actuated without rig 14 flow. In other words, the position of a valve (e.g., valve 70) of the valve subassembly 66 may be regulated by a fluid flow (e.g., a formation fluid flow) through the drilling rig 14 (e.g., the internal flowline 60). For example, when a fluid is flowing through the rig 14, a passive valve component of the valve assembly 66 may be configured to be in a first position (e.g., an open or closed position) and when a fluid is not flowing through the rig 14, the passive valve component may be configured to be in a second position (e.g., an open or closed position) different from the first position.

As mentioned above, the valve assembly 66 may be actively controlled, passively controlled, or both. For example, the motor assembly 100 may be driven by electronics controlled by a user or by a controller. Similarly, the solenoid 160, 180 may be also be driven by electronics controlled by a user or by a controller (e.g., the controller 72 shown in FIG. 2). Moreover, the valve subassembly 66 may include other passively controlled components, such as a passive pressure relief valve (e.g., relief valve 140) or a passive rupture disk. The passively controlled components may be resettable (e.g., a relief valve) or not resettable (e.g., a rupture disk).

Furthermore, as discussed in detail above, the valve assembly 66 may be biased in one position, such as an open position or a closed position. In other words, the valve assembly 66 may be biased to one position in a normal, unpowered, or non-actuated state. For example, the valve subassembly 66 may be biased by the spring 102 or a magnet. The spring or magnet may allow the valve subassembly 66 may with capable of withstanding movement under axial shocks or loads. Additionally, the valve subassembly 66 may include other components such as valves (e.g., check valves), lubrication systems, compensators, flowline measurement sensors, and so forth.

While the valve subassembly 66 may be located anywhere within the LWD tool 40, in certain embodiments, the valve subassembly 66 is positioned along the internal flowline 60 and proximate to the flowline exit 74 of the tool 40. In one embodiment, the valve subassembly 66 may be simplified to be positioned at the end of the internal flowline 60 (e.g., a non-continuous flowline). The valve subassembly 66 may regulate a fluid flow exiting the internal flowline 60 (e.g., to the annulus 30 surrounding the tool 40, to a volume outside the tool 40 and another drilling tool component, or to another internal flowline 60. For example, the fluid flow may be a particle-laden fluid flow, such as an erosion fluid, a plugging fluid, or an equalizing fluid. Moreover, in certain embodiments, various components of the valve subassembly 66, such as actuation mechanisms 58 of the valve subassembly 66, may be extended to other tools, such as the probe module 50 or the pump-out module 52.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A system, comprising:

a valve subassembly configured to be disposed along an internal flowline exit of a first internal flowline within a downhole drilling module, the valve subassembly comprising:

an active valve configured to regulate flow fluid through the internal flowline exit; and a passive valve configured to regulate the flow through the internal flowline exit based on a pressure differential between a first pressure within a first volume defined by a collar surrounding the downhole drilling module and a second pressure within an annulus surrounding the collar when the downhole drilling module is disposed within a wellbore, wherein the first volume is different from the first internal flowline.

2. The system of claim 1, wherein the valve subassembly comprises a biasing spring configured to bias the active valve into a first position and a motor assembly configured to actuate the active valve into a second position, wherein the motor assembly comprises a motor and a roller screw coupled to the active valve.

3. The system of claim 1, comprising a hydraulic circuit configured to actuate the active valve.

4. The system of claim 1, wherein the valve subassembly comprises a biasing spring configured to bias the active valve in a first position and a solenoid configured to actuate the active valve into a second position.

5. The system of claim 1, wherein the valve subassembly comprises a bi-stable position solenoid configured to actuate the active valve into a first position and a second position.

6. The system of claim 1, wherein the passive valve is in a closed position when the first pressure is approximately equal to the second pressure, and the passive valve is in an open position when the first pressure is greater than the second pressure.

7. The system of claim 6, wherein the passive valve comprises a piston and a seal biased by a spring in the closed position when the first pressure is approximately equal to the second pressure.

8. The system of claim 1, comprising the downhole drilling module, wherein the downhole drilling module comprises a probe module, a pump out module, and a sampling module.

9. The system of claim 1, comprising a downhole controller configured to actuate the active valve in response to a user input.

10. The system of claim 1, wherein the internal flowline exit extends to the first volume defined by the collar surrounding the downhole drilling module, the annulus surrounding the collar when the downhole drilling module is disposed within the wellbore, or a second internal flowline.

11. The system of claim 1, wherein the first volume comprises an oil compensation system operatively coupled to the passive valve.

12. A drilling system, comprising:

a downhole drilling module, comprising:

an internal flowline configured to flow a fluid; and an internal flowline exit extending from the internal flowline to an external volume; and a valve subassembly disposed within the downhole drilling module and at the internal flowline exit of the internal flowline, wherein the valve subassembly comprises:

a piston;

a spring configured to bias the piston in a first position; and a seal configured to block flow of the fluid from the internal flowline to the external volume when the piston is biased in the first position, wherein the piston is configured to compress the spring and open the seal when a first pressure within a first volume defined by a collar surrounding the downhole drilling module is greater than a second pressure within an annulus surrounding the collar when the downhole drilling module is disposed within a wellbore, and wherein the first volume is different from the internal flowline.

13. The drilling system of claim 12, wherein the valve subassembly comprises an actively-controlled valve configured to regulate flow of the fluid through the internal flowline exit and an actuating mechanism configured to actuate the actively-controlled valve.

14. The drilling system of claim 13, wherein the actuating mechanism comprises a biasing spring configured to bias the actively-controlled valve into a first position and a motor assembly configured to actuate the actively-controlled valve into a second position, wherein the motor assembly comprises a motor and a roller screw coupled to the actively-controlled valve or a solenoid coupled to the actively-controlled valve.

15. The drilling system of claim 13, wherein the actuating mechanism comprises a hydraulic circuit configured to actuate the actively-controlled valve.

16. The drilling system of claim 13, comprising a controller configured to actuate the actuating mechanism based on feedback from a sensor within the downhole drilling module or input from an operator.

17. The drilling system of claim 12, wherein the first volume comprises an oil compensation system operatively coupled to the valve subassembly.

* * * * *